US008020634B2

(12) United States Patent
Utter et al.

(10) Patent No.: US 8,020,634 B2
(45) Date of Patent: Sep. 20, 2011

(54) METHOD AND APPARATUS FOR SUPPORTING A DOWNHOLE COMPONENT IN A DOWNHOLE DRILLING TOOL

(75) Inventors: Robert Utter, Anchorage, AK (US); Ian Silvester, Houston, TX (US); Kyel Hodenfield, Sugar Land, TX (US); Steven J. Pringnitz, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 535 days.

(21) Appl. No.: 11/244,267

(22) Filed: Oct. 5, 2005

(65) Prior Publication Data

US 2007/0074908 A1 Apr. 5, 2007

(51) Int. Cl.
*E21B 17/12* (2006.01)
*E21B 17/16* (2006.01)

(52) U.S. Cl. ..... 175/57; 175/81; 175/230

(58) Field of Classification Search ..... None
See application file for complete search history.

(56) References Cited

U.S. PATENT DOCUMENTS

| | | | | |
|---|---|---|---|---|
| 3,811,515 | A * | 5/1974 | Bazhal et al. | 173/93 |
| 3,814,180 | A * | 6/1974 | Oliver | 166/99 |
| 3,918,519 | A * | 11/1975 | Cubberly, Jr. | 166/53 |
| 4,265,305 | A | 5/1981 | Stone et al. | |
| 4,433,491 | A | 2/1984 | Ott et al. | |
| 4,537,067 | A | 8/1985 | Sharp et al. | |
| 6,192,748 | B1 | 2/2001 | Miller | |
| 6,507,990 | B1 | 1/2003 | Moreno et al. | |
| 6,571,870 | B2 * | 6/2003 | Zheng et al. | 166/178 |
| 6,725,939 | B2 | 4/2004 | Richard | |
| 6,761,230 | B2 | 7/2004 | Cross et al. | |

FOREIGN PATENT DOCUMENTS

| | | |
|---|---|---|
| EP | 1 184 539 A2 | 3/2002 |
| WO | WO 99/31389 | 6/1999 |
| WO | WO 02/053871 | 7/2002 |

* cited by examiner

*Primary Examiner* — Zakiya W. Bates
(74) *Attorney, Agent, or Firm* — John Vereb; Jeremy Welch

(57) ABSTRACT

An apparatus for supporting a retrievable downhole component within a drill collar includes a sleeve that is positionable about the downhole component and is mounted within the drill collar. The sleeve is adapted to limit the lateral movement of the downhole component. The sleeve includes a series of fins or is lined with an energy absorbing material which protects the component from shock and vibration while at the same time enables the component to be retrieved should the drill string become stuck in the borehole.

21 Claims, 8 Drawing Sheets

METHOD AND APPARATUS FOR SUPPORTING A DOWNHOLE COMPONENT IN A DOWNHOLE DRILLING TOOL

FIELD OF THE INVENTION

The present invention relates to downhole drilling tools that are used in wellbore operations. More particularly, the present invention relates to a protective support for isolating downhole drilling tools from high shock and vibration intrinsic to the drilling process in a wellbore penetrating a subterranean formation.

BACKGROUND OF THE RELATED ART

Wellbores are drilled at wellsites to locate and produce hydrocarbons. A downhole drilling tool with a bit at an end thereof is advanced into the ground to form a wellbore. As the drilling tool is advanced, a drilling mud is pumped from a surface mud pit, through the drilling tool and out the drill bit to cool the drilling tool and carry away cuttings. The fluid exits the drill bit and flows back up to the surface for recirculation through the tool. The drilling mud is also used to form a mudcake to line the wellbore.

FIG. 1 illustrates a wellsite system 1 which includes a surface system 2, a downhole system 3 and a surface control unit 4. In the illustrated embodiment, a borehole 11 is formed by rotary drilling in a manner that is well known.

The downhole system 3 includes a drill string 12 suspended within the borehole 11 with a drill bit 15 at its lower end. The surface system 2 includes the land-based platform and derrick assembly 10 positioned over the borehole 11 penetrating a subsurface formation F. The assembly 10 includes a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook.

The surface system further includes drilling fluid or mud 26 stored in a pit 27 formed at the well site. A pump 29 delivers the drilling fluid 26 to the interior of the drill string 12 via a port in the swivel 19, inducing the drilling fluid to flow downwardly through the drill string 12 as indicated by the directional arrow 9. The drilling fluid exits the drill string 12 via ports in the drill bit 15, and then circulates upwardly through the region between the outside of the drill string and the wall of the borehole, called the annulus, as indicated by the directional arrows 32. In this manner, the drilling fluid lubricates the drill bit 15 and carries formation cuttings up to the surface as it is returned to the pit 27 for recirculation.

The drill string 12 further includes a bottom hole assembly (BHA), generally referred to as 100, near the drill bit 15 (in other words, within several drill collar lengths from the drill bit). The bottom hole assembly includes capabilities for measuring, processing, and storing information, as well as communicating with the surface. The BHA 100 thus includes, among other things, an apparatus 110 for determining and communicating one or more properties of the formation F surrounding borehole 11, such as formation resistivity (or conductivity), natural radiation, density (gamma ray or neutron), and pore pressure.

The BHA 100 further includes drill collars 130, 150 for performing various other measurement functions. Drill collar 150 houses a measurement-while-drilling (MWD) tool. The MWD tool further includes an apparatus 160 for generating electrical power to the downhole system. While a mud pulse system is depicted with a generator powered by the flow of the drilling fluid 26 that flows through the drill string 12 and the MWD drill collar 150, other power and/or battery systems may be employed.

Sensors are located about the wellsite to collect data, preferably in real time, concerning the operation of the wellsite, as well as conditions at the wellsite. For example, monitors, such as cameras 6, may be provided to provide pictures of the operation. Surface sensors or gauges 7 are disposed about the surface systems to provide information about the surface unit, such as standpipe pressure, hookload, depth, surface torque, rotary rpm, among others. Downhole sensors or gauges 8 are disposed about the drilling tool and/or wellbore to provide information about downhole conditions, such as wellbore pressure, weight on bit, torque on bit, direction, inclination, collar rpm, tool temperature, annular temperature and toolface, among others. The information collected by the sensors and cameras is conveyed to the surface system, the downhole system and/or the surface control unit.

The MWD tool 150 includes a communication subassembly 152 that communicates with the surface system. The communication subassembly 152 is adapted to send signals to and receive signals from the surface using mud pulse telemetry. The communication subassembly may include, for example, a transmitter that generates a signal, such as an acoustic or electromagnetic signal, which is representative of the measured drilling parameters. The generated signal is received at the surface by transducers, represented by reference numeral 31, that convert the received acoustical signals to electronic signals for further processing, storage, encryption and use according to conventional methods and systems. Communication between the downhole and surface systems is depicted as being mud pulse telemetry, such as the one described in U.S. Pat. No. 5,517,464, assigned to the assignee of the present invention. It will be appreciated by one of skill in the art that a variety of telemetry systems may be employed, such as wired drill pipe, electromagnetic or other known telemetry systems.

Downhole tools, such as those in BHA 100, are subjected to high shock and extreme vibration intrinsic to the drilling process. These high shock and vibration loads can significantly reduce the efficiency, accuracy and reliability of the tools. Shock and vibration may be of particular concern when the tools carry delicate and sensitive electronics equipment, such as the measuring and communications assemblies described above. MWD tools and their associated sensors may, for example, especially susceptible to damage and inaccurate performance in high shock and vibration environments.

The borehole depicted in FIG. 1 is oriented vertically in a downward direction from ground level as is typical at a wellsite. Boreholes are, however, often required to be formed in a diagonal, horizontal or upward direction with respect to the drilling surface. Despite the orientation, the drilling tools are typically subjected to significant shock and vibration. Those of ordinary skill in the art, given the benefit of this disclosure, will appreciate that the present invention also finds application in drilling applications other than conventional wellsites as illustrated in FIG. 1 and this invention is not limited thereto.

The industry has attempted to address the adverse effects of shock and vibration on downhole tools in a number of ways, such as the use of specially designed drill collars to protect the delicate components in the drilling tools. While such collars provide a measure of protection against shock and vibration, they are often expensive to make, to deploy in the borehole and to maintain. Moreover, the special design and expense of these protective collars can limit their use at other locations in the drill string.

Drill collars primarily are designed to provide structure to the drill string and to serve as a passageway for the drilling tools and drilling mud into the borehole as illustrated in FIG. 1. Drill collars are a required fixture at most drill sites and come in various lengths and diameters. It is not uncommon for a wellsite to require several hundred drill collars in order to complete the borehole to the required depth.

Thus, the industry has developed manufacturing techniques and economies for making drill collars for their conventional and passive purposes relatively inexpensively. When drill collars must also perform an active function, such as protecting drilling tools from the harmful effects of shock and vibration from the drilling operation, the special design and materials required for these purposes greatly increases the cost of the drill collar and discourages their use for more conventional purposes.

Some protective drill collars have been used in an attempt to limit the internal displacement of the various tool components within the collar. The tool components are typically installed inside the protective collar and physically attached to its interior. While this approach may provide a measure of protection, the protective collar and the tool components are typically very expensive and often cannot be retrieved if stuck. Thus, while some degree of protection may be achieved, the costs of such a protective collar and its tool components can be very expensive. The risk of such a financial loss often deters the use of protective collars for expensive tool components, such as MWDs. Even in cases where retrievability is possible by providing a protective collar, the impact on the cost to operate the service can become prohibitive in many situations.

Various techniques have been developed for protecting various downhole components within drilling tools. See, for example, U.S. Pat. Nos. 6,761,230; 4,265,305 and 4,537,067. Some such techniques involve the use of centralizers or rings positioned within the drill collar to protect internal components.

Despite the development and advancement of various approaches to protecting downhole components within drill collars or other housings of downhole tools, there remains a need to provide such protection in a more economical manner. It is desirable that a protection system be provided that permits the retrievable of the downhole components should the downhole tool become stuck in the borehole. It is further desirable that such a protection system not require the use of specially designed and/or expensive drilling collar. Preferably, such as protection system provides one or more of the following, among others: retrievability of the downhole components reduced manufacturing costs, reduced maintenance costs, enhanced component protection, reduced shock and/or vibration.

SUMMARY OF THE INVENTION

In at least one aspect, the present invention relates to an apparatus for supporting a retrievable downhole component within a drill collar of a downhole drilling tool deployed from a rig into a wellbore penetrating a subterranean formation. The apparatus includes a support or sleeve that is positionable about the downhole component and is located within the drill collar. The sleeve is adapted to limit the lateral movement of the downhole component within the drill collar.

In another aspect, the invention relates to a downhole drilling tool for supporting a retrievable downhole component therein. The downhole drilling tool is deployed via a drill string from a rig into a wellbore penetrating a subterranean formation. The drilling tool includes at least one drill collar operatively connected to the drill string, a retrievable downhole component that is removably positionable within the drill collar and a sleeve that is positionable within the drill collar. The sleeve is adapted to limit the lateral movement of the retrievable downhole component within the drill collar.

Finally, in another aspect, the invention relates to a method of supporting a retrievable downhole component within a downhole drilling tool that is deployed from a rig into a wellbore penetrating a subterranean formation. The method includes operatively connecting a drill collar of the downhole tool to a drill string and positioning a sleeve in the downhole tool about the retrievable downhole component such that the sleeve limits the degree of lateral movement of the retrievable downhole component within the drill collar.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
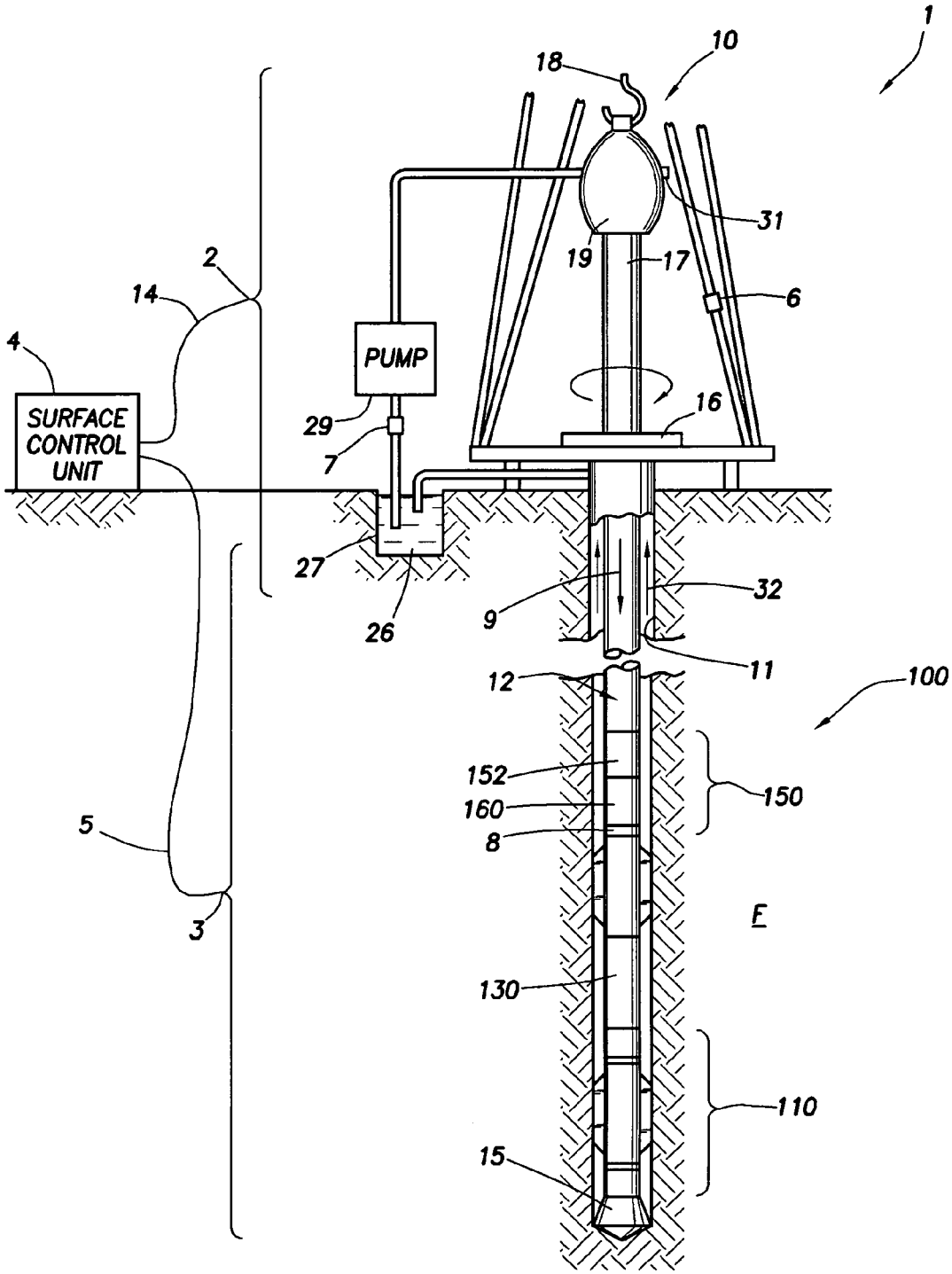
FIG. 1 is a schematic view, partially in cross-section of a prior art MWD tool and wellbore telemetry device connected to a drill string and deployed from a rig and into a wellbore.

Presently preferred embodiments of the invention are shown in the above identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

Figure 2:
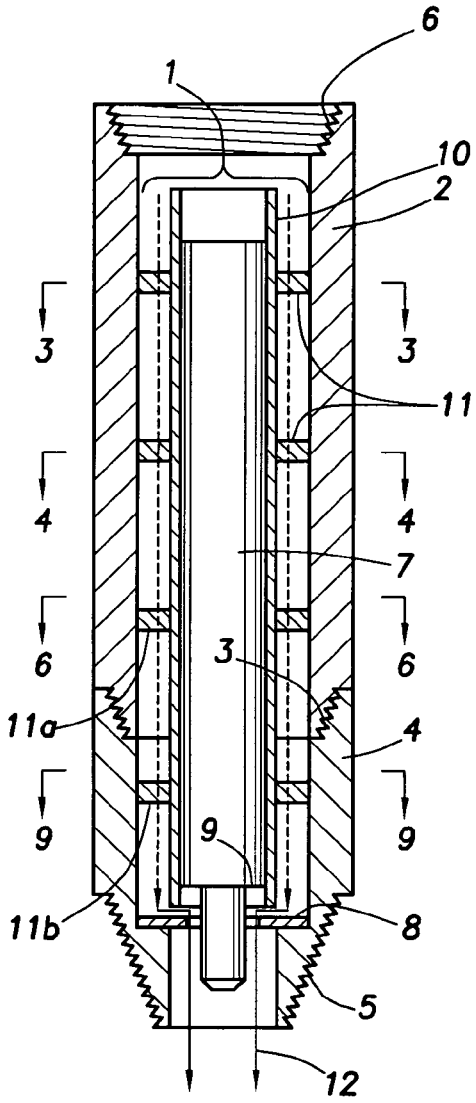
FIG. 2 is a longitudinal cross-sectional view of a drill collar and drilling tool component, the drilling tool component having a protective sleeve thereabout.

Referring to FIG. 2, a protective sleeve 1 for a downhole component 7 of a downhole tool, such as the downhole tool 100 of FIG. 1, is provided. While FIG. 1 depicts a drilling tool, it will be appreciated that such a protective sleeve may be used in a variety of downhole tools, such as a drilling, wireline, coiled tubing, completions or other downhole tool.

As shown, the protective sleeve is positioned in a drill collar 2 and an adjacent landing sub 4 for supporting a downhole component. However, the protective sleeve may be positioned within one or more drill collars and/or landing subs, or other modules or housing depending on the application. The drill collar and/or sub may be machined and/or cut to the desired length to meet the needs of the wellbore application. Such cuts may be made to the drill collar for maintenance, repair and/or manufacture. Re-cuts and re-threads may be performed as desired.

The protective sleeve 1 includes a centralizing tube 10 and a plurality of fins 11. The protective sleeve preferably supports the component 7 therein from wellbore and/or drilling conditions. The protective sleeve is preferably adapted to restrict the movement of downhole components, and/or isolate the component from shock and vibration.

The tube, generally indicated by reference number 10, is preferably positioned inside the drill collar. The drill collar may be, for example, a conventional low cost monel drill collar 2. Drill collar 2 preferably has a threaded downhole end 3 for threadedly connecting to an adjacent drill collar as is known in the art. Landing sub 4 likewise has a threaded downhole end 5 for threadedly connecting to an adjacent downhole drill collar (not shown) in order to continue the drill string structure in the downhole direction. Drill collar 2 also has an uphole treaded end 6 for threadedly connecting to an adjacent uphole drill collar (not shown) in order to continue the drill string structure in the uphole direction.

The downhole component for which sleeve 1 serves to protect can be one of a number of difference components, such as an MWD and/or telemetry tool, a gyroscopic tool, etc. The example used in FIG. 2, for illustrative purposes only, is an MWD telemetry tool 7. MWD tool 7 is inserted into drill collar 2 and extends into landing sub 4.

Landing sub 4 includes an integrally formed landing shoulder 8 which serves as downhole support and orientation for drilling tool components such as MWD tool 7 shown in FIG. 2. MWD tool 7 has a corresponding resting pad 9 which rest upon landing shoulder 8. Preferably, the weight of MWD tool 7, landing shoulder 8 and/or the forces and pressures within the drill string maintain MWD tool 7 in its desired location.

Centralizing tube 10 is preferably formed of tubular construction. The tube is preferably of sufficient length to enclose the drilling tool component to be protected. Tube 10 may be made of metal, such as stainless steel or a steel alloy. In fact, centralizing tube 10 may also be a low cost monel drill collar positionable within low cost monel drill collar 2.

Centralizing tube 10 includes a plurality of centralizer fins 11, 11*a*, 11*b* attached to its exterior diameter and which extend outward to the interior diameters of Drill collar 2 and landing sub 4. The fins preferably extend between sleeve 10 and drill collar 2 to support the sleeve and the component housed therein.

The number, type and position of fins 11 needed to maintain centralizing tube 10 in a stable position is a matter of design choice for one of ordinary skill in the art. Four sets of fins are depicted in FIG. 2, but the invention is not limited to this number. A fewer or a larger number of fins can be used, depending on the particular needs of the drilling operation. A variety of types, geometries and configurations may be used as will be described more fully below.

Fins 11 may be made of the same material as centralizing tube 10 or may be formed of any other material of suitable strength and rigidity necessary to maintain centralizing tube 10 in a stable position within Drill collar 2 and landing sub 4 in the presence of shock and vibration caused by the drilling operation. Fins 11 may be attached to centralizing tube 10 using a number of conventional attachment techniques, such as, molding, adhesives, or interference press fits.

Figure 3:
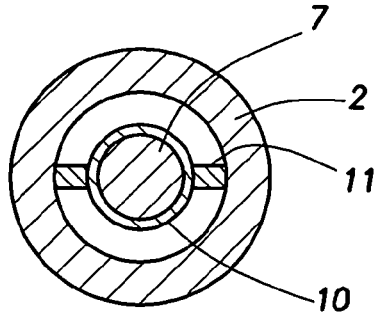
FIG. 3 is a horizontal cross-sectional view of the drill collar, a drilling tool component and protective sleeve as depicted in FIG. 2 taken along line 3-3.
Figure 4:
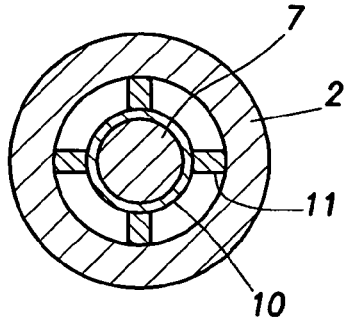
FIG. 4 is a horizontal cross-sectional view of the drill collar, a drilling tool component and protective sleeve as depicted in FIG. 2 taken along line 4-4.

Various fin configurations are shown in greater detail in FIGS. 3-1. Each of fins 11 are arranged about centralizing tube 10 as illustrated in the cross-sectional views shown in FIGS. 3 and 4. FIGS. 3 and 4 are taken along line 3-3 and line 4-4, respectively, in FIG. 2. Fin 11 can be positioned around centralizing tube 10 so that each fin is aligned with respect to vertically adjacent fins as shown in FIG. 3 or may be offset by some number of degrees from immediately adjacent fins as shown in FIG. 4. As shown, the fins of FIGS. 3 and 4 are rectangular. However, other geometries are possible.

Figure 5:
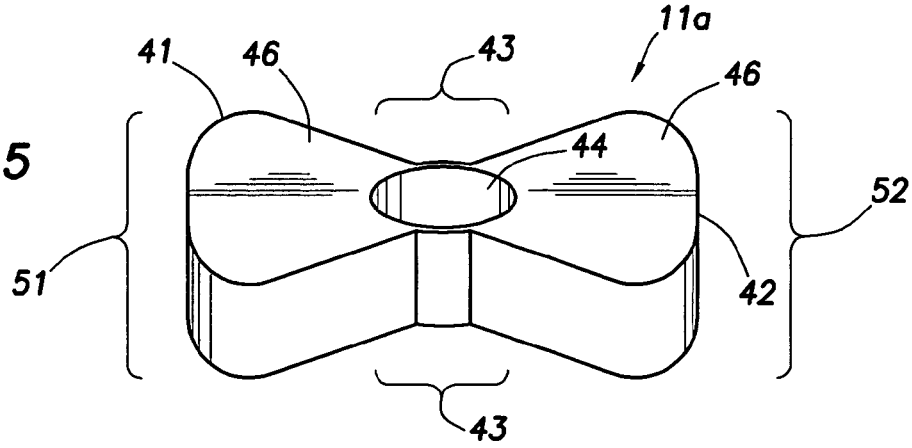
FIG. 5 is a perspective view of another fin of a protective sleeve.

FIG. 5 depicts the construction of a fin 11 a in greater detail. Fin 11 a has a left lobe 41 and a right lobe 42 with a void area 43 separating the lobes. The void area 43 permits the passage of mud between the lobes when the fin is positioned in a drill collar. The fin also includes a center hole 44 through which centralizing tube 10 is positioned.

The fin shown in FIG. 5 may be molded from a hard rubber or other elastomer material. The fin may be integrally formed with centralizing tube 10 using known molding techniques. Alternatively, the fin may be separate from the centralizing tube and operatively connected thereto.

Figure 6:
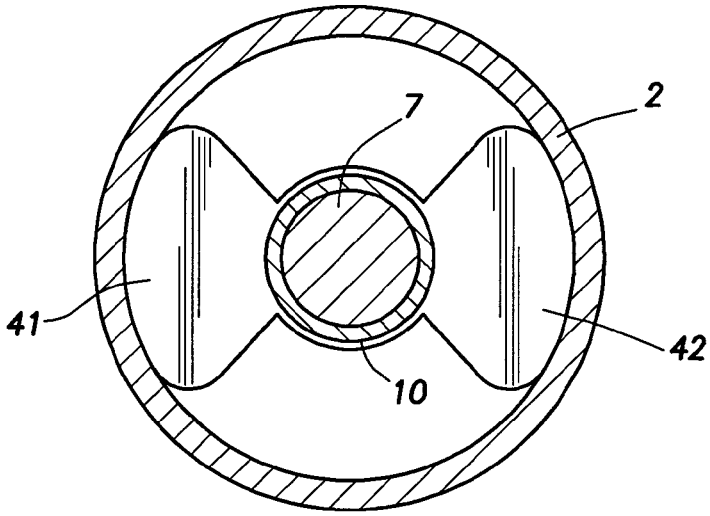
FIG. 6 is a horizontal cross-sectional view the drill collar, drilling tool component and protective sleeve of FIG. 2, taken along line 6-6, with the fin of FIG. 5.

FIG. 6 is a horizontal cross-sectional view of the drill collar of FIG. 2 taken along line 6-6 with fin 1 la of FIG. 5 positioned therein.

Arrows 12 in FIG. 2 indicates the flow of drilling mud through drill collar 2 and land sub 4. Note that the flow of mud travels between the inside walls of drill collar 2 and landing sub 2 and the outside wall of centralizing tube 10. Voids 43 allow the drilling mud to easily flow pass fin 11. Upper surface 46 of fin 11 also is preferably formed with an aerodynamic profile to aid the flow of the drilling mud pass fin 11.

The type of material used to make fin 11 and the length of outer portions 51 and 52 of lobes 41 and 42, which come into contact with the interior diameters of drill collar 2 and landing sub 5, may be selected to provide sufficient lateral support to centralizing tube 2. The lobes 41 and 42 are preferably configured to substantially absorb the shock and vibrations incident to the drilling operation. Some shock and vibration may also be absorbed by centralizing tube 2. Preferably, a minimum amount of shock and vibration, if any, reaches the downhole components, such as MWD 7, positioned within the drill collar thus protecting the tools from these harmful effects.

In some drilling operations, it might be sufficient for fin 11 to be formed with two lobes 41 and 42 as shown in FIGS. 5 and 6. In other drilling operations that require more support for centralizing tube 10, fin 11 may be formed with additional lobes, such as lobes 71, 72 and 73 illustrated in FIG. 7. The number of lobes required for a particular operation is a matter of design choice for the person of ordinary skill in the art. Note that as pointed out above, boreholes may be formed in diagonal, horizontal and vertical directions as well as the conventional downward direction at a conventional wellsite. Thus, the amount of support necessary for centralizing tube 10 will depending on the particular drilling operation.

The upper surface of lobes 71-73 also preferably have an aerodynamic profile to aid the flow of drilling mud pass each lobe through voids 74.

Figure 8:
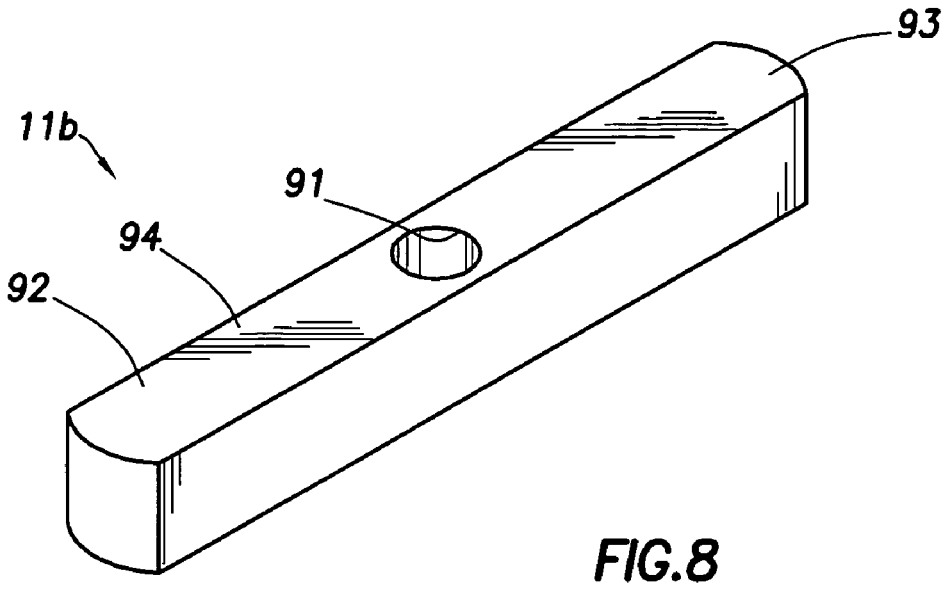
FIG. 8 is a perspective view of another fin used to form a protective sleeve as illustrated in FIG. 2.

FIG. 8 depicts the configuration of fin 11*b* in greater detail. This fin has two lobes 92 and 93, with a center passage 91 through which centralizing tube 10 can pass. The outer ends of lobes 92 and 93 of the fin extends out to the exterior diameter of centralizing tube 10 to provide support as illustrated in FIG. 9.

The upper surface 94 of the fin is preferably formed with an aerodynamic profile to aid the flow of drilling mud pass the fin.

Figure 9:
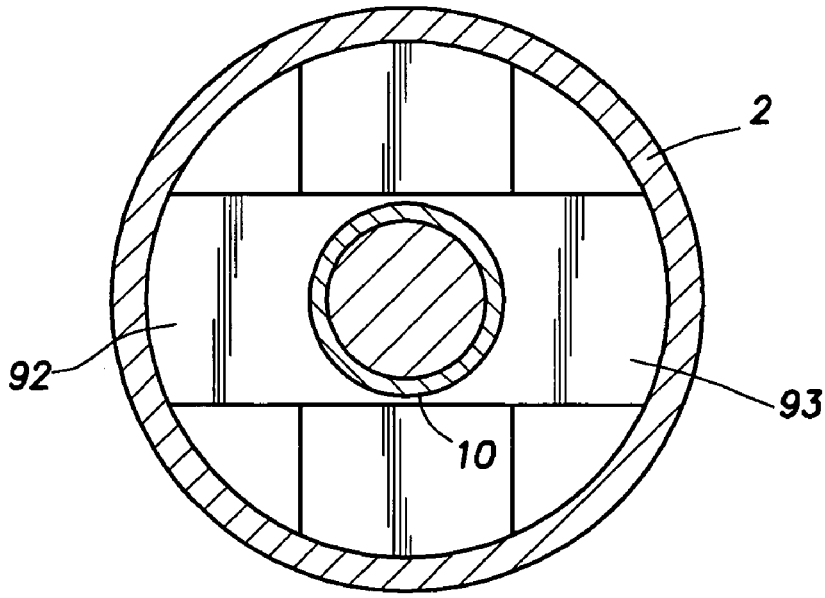
FIG. 9 is a horizontal cross-sectional view of the drill collar, drilling tool component and protective sleeve of FIG. 2 taken along line 9-9, with the fin of FIG. 8.

FIG. 9 is a horizontal cross-sectional view of drill collar 2 taken along line 9-9 in FIG. 2 where two fins 11*a* are formed of the construction depicted in FIG. 8. As shown in FIG. 9, fins 11*b* is arranged around centralizing tube 10 so that vertically adjacent fins are offset from each other. Positioning the fins in this manner provides uniform support to centralizing tube 10 in the presence of shock and vibration during the drilling operation.

Figure 7:
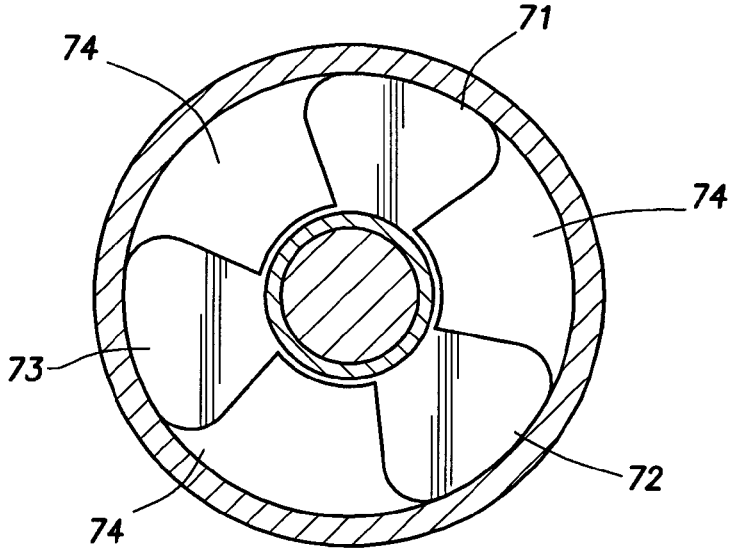
FIG. 7 is a horizontal cross-sectional view of the drill collar, drilling tool component and protective sleeve of FIG. 6, with the fin of FIG. 5 having three lobes.

Like the configurations of fin 11*a* depicted in FIG. 5-7, the fin 11*b* shown in FIGS. 8 and 9 may be formed of the same material as centralizing tube 10 or may be formed of any material of suitable strength and rigidity necessary to maintain centralizing tube 10 in a stable position within drill collar 2 and landing sub 4 in the presence of shock and vibration caused by the drilling operation.

Figure 10:
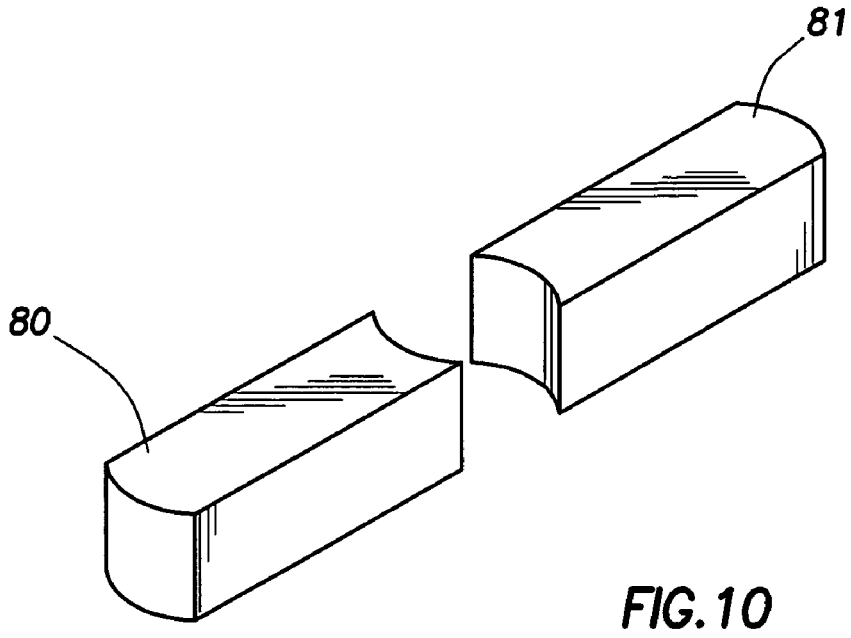
FIG. 10 is a perspective view of the fin of FIG. 8 having separate lobes.
Figure 11:
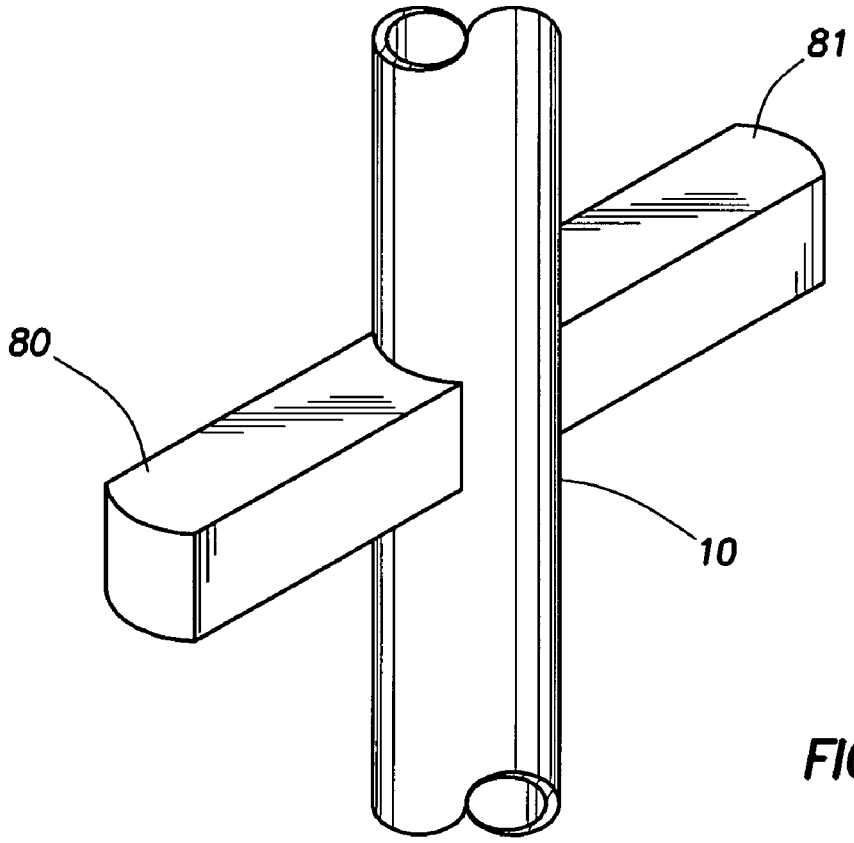
FIG. 11 is a perspective view of the fin as depicted in FIG. 10 with a centralizing tube attached thereto.

FIG. 10 depicts fin 11*b* having separate lobes 80 and 81 In this configuration, lobes 80 and 81 are of the same construction. The lobes may then be attached to the exterior wall of centralizing tube 10 as depicted in FIG. 11.

Each fin member 80 and 81 may be formed of hard rubber or other elastomer material. Fin 11*b* may be formed by way of injection molding using a process well known in the art. Each fin member may be attached to centralizing tube 10 using a number of attachment techniques, such as adhesives, rivets, nuts and bolts and screws in cooperation with corresponding elements attached to centralizing tube 10.

Centralizing tube 10 and associated fins 11, 11*a*, 11*b*, as illustrated in FIGS. 2-11 preferably minimize shock and vibration transmission into the MWD tool 7 by significantly reducing the relative motion between drill collar 2 and the MWD tool. This restriction in motion also reduces the potential for high shock impact between the two. Thus, very delicate and expensive downhole drilling tools, such as MWD tool 7, are protected from physical damage that otherwise would occur in the drilling environment.

Use of centralizing tube 10 and associated fins 11 may be used to eliminate the need for specially designed and expensive drill collars. However, should a drill collar be used for centralizing tube 10, the collar can be of the low cost rental monel type that is customarily used throughout the drill string. In the event that the drill string becomes stuck in the borehole, the drilling tool components can easily be retrieved from the inside of centralizing tube 10. Thus the tool component is not sacrificed at the expense of providing protection from shock and vibration in the borehole.

A plurality of fins 11, 11*a* and/or 11*b* may also be attached directly to the drilling tool component, thus eliminating the need for centralizing tube 10. Ideally, the method of attachment should be such that the fins can easily break away or shear off so that the drilling tool component can be retrieved from the borehole should the drill string become stuck. Methods of attachment that provide such functionality are well know to those in the art and include adhesives, breakable plastic and/or glass fasteners and the like. Here again, the retrievability of the drilling tool is not sacrificed by providing the tool with protection from shock and vibration in the borehole.

Figure 12:
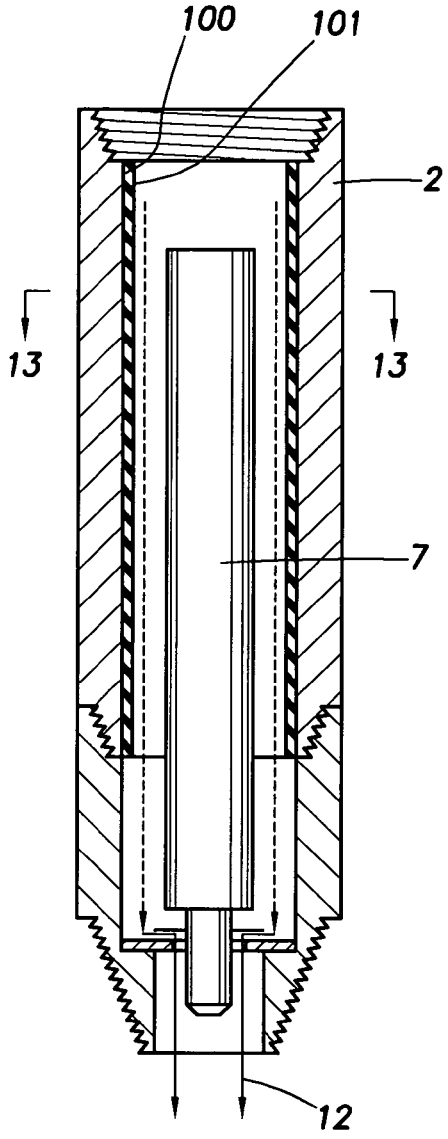
FIG. 12 is a longitudinal cross-sectional view of a drill collar and a drilling tool component, the drill collar having an alternative protective sleeve lining an inner surface thereof

FIG. 12 depicts an alternate protective sleeve 101 positioned on an inner surface of a drill collar 2. The inside wall 100 of drill collar 2 is lined with protective sleeve 101 in the form of an energy absorbing layer 101, such as rubber. Other materials may also be used which have energy absorbing characteristics.

A number of techniques are known in the art for applying layer 101 to the inside of drill collar 2. Such techniques include extruding layer 101 onto the interior of drill collar 2 using an internal mandrill and various thermo setting processes known to those of skill in the art. Layer 101 may also be attached using adhesives or may be formed of a sleeve and inserted inside of drill collar 2.

Figure 13:
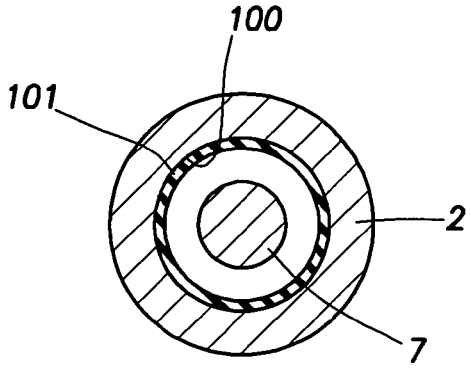
FIG. 13 is a horizontal cross-sectional view the drill collar, a drilling tool component and protective sleeve as depicted in FIG. 12 taken along line 13-13.

FIG. 13 is a horizontal cross-sectional view taken along line 13-13 in FIG. 12. This figure illustrates the position of layer 101 with respect to drill collar 2 and MWD tool 7 being protected. This figure shows that the protective sleeve or layer 101 is positioned between the collar 2 and the downhole component 7. In this position, the layer 101 may be used to absorb any impact between the downhole component and the drill collar, thereby reducing the effects of an impact therebetween on the downhole component.

Figure 14:
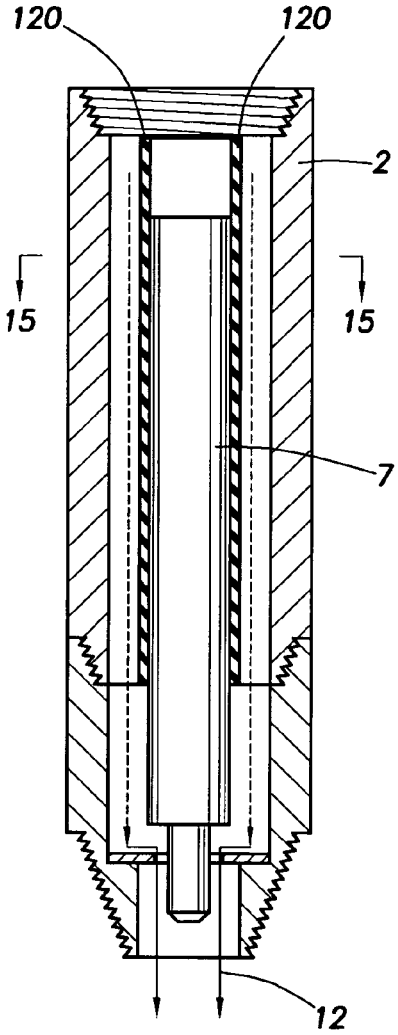
FIG. 14 is a longitudinal cross-sectional view of a drill collar and a drilling tool component, the drilling tool component having a protective sleeve lining an outer surface thereof.

FIG. 14 illustrates another a protective sleeve 120 positioned in a drill collar 2. MWD tool 7 is itself covered by the protective sleeve or layer 120. Preferably, the protective sleeve is made of energy absorbing material, such as rubber. Like the sleeve or layer depicted in FIGS. 12 and 13, MWD tool 7 may, alternatively, be covered with other materials that have energy absorbing characteristics.

A number of techniques are known in the art for applying layer 120 to MWD tool 7. Such techniques include molding the layer onto tool 7 or using various other thermo setting processes known to those of skill in the art.

Figure 15:
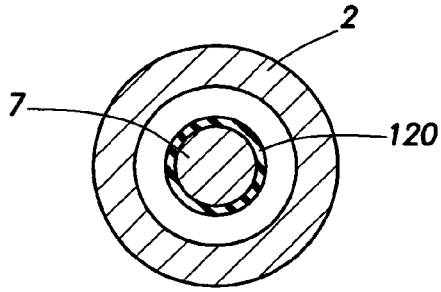
FIG. 15 is a horizontal cross-sectional view of a drill collar, a drilling tool component and a protective sleeve as depicted in FIG. 14 taken along line 15-15.

FIG. 15 is a horizontal cross-sectional view taken along line 15-15 in FIG. 14. This figure shows the position of layer 120 with respect to drill collar 2 and MWD tool 7 being protected. This figure shows that the protective sleeve or layer 120 is positioned between the collar 2 and the downhole component 7. In this position, the layer 101 may be used to absorb any impact between the downhole component and the drill collar, thereby reducing the effects of an impact therebetween on the downhole component.

Figure 16:
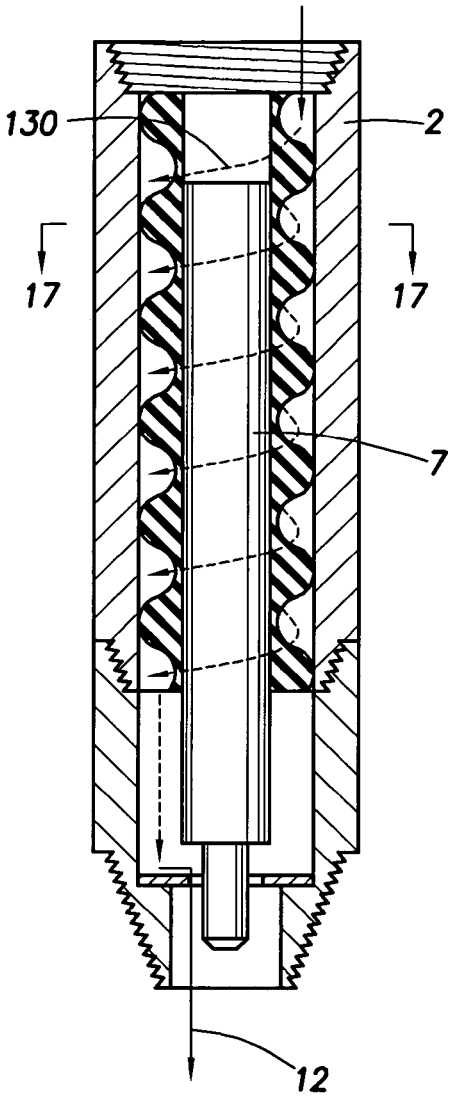
FIG. 16 is a longitudinal cross-sectional view of a drill collar and a drilling tool component deployed into a wellbore from a rig via a drill string, the drill collar having a helically shaped protective sleeve positioned therein.

FIG. 16 shows another version of a protective sleeve 130 positioned in a drill collar 2. The outer surface of the downhole component 7 has a layer 130 made of an energy absorbing material, such as rubber. Layer 130 is formed in a helix profile along the length of drill collar 2. The helical profile is illustrated by the flow of drilling mud through drill collar 2 and indicated by arrow 12. The layer 130 may be positioned on the inner surface of the drill collar 2 and/or the outer surface of the downhole component.

Figure 17:
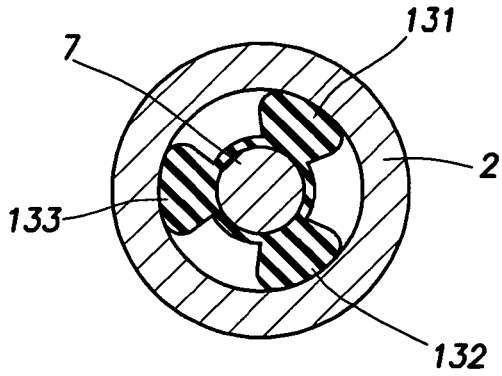
FIG. 17 is a horizontal cross-sectional view of a drill collar, a drilling tool component and a protective layer as depicted in FIG. 16 taken along line 17-17.

FIG. 17 is a horizontal cross-sectional view of the drill collar 2 taken along lines 17-17 in FIG. 16. This figure illustrates the profile of lobes 131, 132 and 133 with respect to drill collar 2 and the MWD tool 7 being protected.

Layer 130 can be attached permanently to the interior of drill collar 2 or insert loaded into the collar using techniques know in the art. Some examples of helical rubber liners used in motor stators and techniques for making such motors are described in U.S. Pat. No. 9,931,389. Lobes 131, 132 and 133 provide a surface for centralizing MWD tool 7, and thus minimize shock transmission to tool 7. Space between the lobes is also provided to permit the passage of mud therethrough.

The sleeves illustrated in FIG. 12-17 may also be used to eliminate the need for specially designed and expensive drill collars while at the same time allowing the drilling tools, such as MWD tool 7, to be retrieved should the drill string becomes stuck in the borehole.

Various combinations of the sleeves depicted in FIGS. 2-17 may be used. For example, the sleeve 101 of FIG. 12 may be positioned on drill collar 2, and an additional sleeve 120 may be positioned on downhole component 7. Other combinations may be envisioned. Moreover, multiple layers of material may be used to make up portions of the sleeves and/or tubes. Reinforcements may also be provided therein.

It will be understood from the foregoing description that various modifications and changes may be made in the various embodiments of the present invention without departing from its true spirit. Thus, this description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. An apparatus for supporting a retrievable downhole component within a drill collar comprising:

a tubular sleeve configured to removably receive said downhole component within said drill collar, said downhole component being removable from said tubular sleeve while said drill collar is in a downhole position, wherein the downhole component is a telemetry tool, a rotary steerable tool, a logging while drilling tool or measurement while drilling tool;

at least one support for affixing the tubular sleeve inside an interior of the drill collar, the support configured to limit lateral movement of said sleeve within said drill collar.

2. The apparatus of claim 1, wherein said retrievable downhole component is a telemetry tool.

3. The apparatus of claim 1, wherein said retrievable downhole component is a rotary steerable tool.

4. The apparatus of claim 1, wherein said retrievable downhole component is a measurement while drilling tool.

5. The apparatus of claim 1, wherein said retrievable downhole component is a logging while drilling tool.

6. The apparatus of claim 1, wherein said support includes a plurality of fins.

7. The apparatus of claim 6, wherein at least one of said fins has a plurality of lobes, said lobes serving to limit said lateral movement of said retrievable downhole component.

8. The apparatus of claim 7, wherein each of said fins is in the same general alignment with respect to adjacent ones of said fins.

9. The apparatus of claim 7, wherein each of said fins is in a different general alignment with respect to adjacent ones of said fins.

10. The apparatus of claim 6, wherein said plurality of fins are integrally formed with said support.

11. The apparatus of claim 1, wherein said sleeve is formed of rubber.

12. The apparatus of claim 1, wherein said support includes of layer of elastic material formed thereon.

13. The apparatus of claim 1, wherein said support has a helical inner surface.

14. The apparatus of claim 1, wherein said sleeve is positioned within said drill so that drilling fluid may pass there through.

15. A downhole drilling tool for supporting a retrievable downhole component therein, comprising:

at least one drill collar operatively connected to a drill string;

a sleeve affixed within said at least one drill collar, said sleeve affixed within said at least one drill collar by a support configured limit the lateral movement of said sleeve within said at least one drill collar, wherein said sleeve is of tubular construction, and further wherein said support has a plurality of fins and;

a downhole component retrievably disposed within said sleeve, said downhole component being removable from said sleeve while said drill collar is in a downhole position.

16. The downhole drilling tool of claim 15, wherein said sleeve is formed of rubber.

17. The downhole drilling tool of claim 15, wherein said sleeve includes of layer of elastic material formed thereon.

18. A method of supporting a retrievable downhole component within a downhole drilling tool comprising:

operatively connecting a drill collar of said downhole tool to a drill string;

positioning a sleeve in said drill collar, the sleeve engaged with the drill collar by a support such that lateral movement of said sleeve is limited within said drill collar; and retrievably inserting the downhole component in the sleeve such that the downhole component is retrievable from said sleeve while said drill collar is in a downhole position, wherein the downhole component is a telemetry tool, a rotary steerable tool, a logging while drilling tool or measurement while drilling tool.

19. The method of claim 18 further including the step of deploying a component for retrieving said retrievable downhole component.

20. The method of claim 18 further including the step of operating said retrievable downhole component.

21. The method of claim 18 further including the step of passing a drilling mud through said collar and said sleeve.

* * * * *